US006199771B1

(12) United States Patent
Clearman et al.

(10) Patent No.: US 6,199,771 B1
(45) Date of Patent: Mar. 13, 2001

(54) SINGLE CHAMBER SPRAY HEAD WITH MOVING NOZZLE

(75) Inventors: Joseph H. Clearman, Port Gamble, WA (US); Jack F. Clearman, Blakely, GA (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/352,837

(22) Filed: Jul. 13, 1999

Related U.S. Application Data

(60) Provisional application No. 60/108,627, filed on Nov. 16, 1998.

(51) Int. Cl.[7] ..... B05B 3/02; B05B 3/16

(52) U.S. Cl. ..... 239/222.11; 239/222.17; 239/222.19; 239/231; 239/381; 239/382; 239/499

(58) Field of Search ..... 239/222, 222.11, 239/222.13, 222.17, 222.15, 222.19, 222.21, 231, 255, 380, 381, 382, 499

(56) References Cited

U.S. PATENT DOCUMENTS

| | | | | |
|---|---|---|---|---|
| 726,200 | * | 4/1903 | Stover | 239/499 |
| 1,055,411 | * | 3/1913 | McWilliams | 239/382 X |
| 2,151,214 | | 3/1939 | Kramer . | |
| 2,186,786 | | 1/1940 | Jensen . | |
| 2,622,927 | | 12/1952 | Sarbu . | |
| 2,639,191 | | 5/1953 | Hruby, Jr. . | |
| 2,831,333 | | 4/1958 | Smith . | |
| 2,848,276 | | 8/1958 | Clearman . | |
| 2,902,851 | | 9/1959 | Fields . | |
| 2,931,201 | | 4/1960 | Hubbard . | |
| 2,954,171 | | 9/1960 | Hruby, Jr. . | |
| 2,967,024 | | 1/1961 | Aubert . | |
| 2,974,877 | | 3/1961 | Hruby, Jr. . | |
| 3,000,575 | | 9/1961 | Hruby, Jr. . | |
| 3,009,648 | | 11/1961 | Hait . | |
| 3,034,728 | | 5/1962 | Hruby, Jr. . | |
| 3,091,400 | | 5/1963 | Aubert . | |
| 3,126,025 | | 3/1964 | Aubert et al. . | |
| 3,357,643 | | 12/1967 | Hruby, Jr. . | |
| 3,447,749 | | 6/1969 | Hruby, Jr. . | |
| 3,734,410 | | 5/1973 | Bruno . | |
| 3,791,584 | | 2/1974 | Drew et al. . | |
| 3,826,429 | | 7/1974 | Moen . | |
| 3,880,357 | | 4/1975 | Baisch . | |
| 3,929,287 | | 12/1975 | Givler et al. . | |

(List continued on next page.)

FOREIGN PATENT DOCUMENTS

| | | |
|---|---|---|
| 42 21 587 A1 | 1/1994 | (DE) . |
| 42 24 664 A1 | 1/1994 | (DE) . |
| 0676241 | 10/1995 | (EP) . |
| 0836888 | 4/1998 | (EP) . |
| 0841096 | 5/1998 | (EP) . |
| 03231620 | 10/1991 | (JP) . |

*Primary Examiner*—Andres Kashnikow
*Assistant Examiner*—Robin O. Evans
(74) *Attorney, Agent, or Firm*—Cook, Alex, McFarron, Manzo, Cummings & Mehler, Ltd.

(57) ABSTRACT

The present invention provides a fluid discharging apparatus that delivers fluid in a substantially uniform distribution. The movement of the apparatus is a wobbling motion, preferably combined with some rotational motion. The wobbling motion is generated by disposing a wobble inducing member or wobble turbine in the path of the fluid supply. The water flowing over the wobble turbine causes the turbine to wobble. In certain embodiments, the wobbling turbine then causes the body or housing to wobble.

26 Claims, 15 Drawing Sheets

U.S. PATENT DOCUMENTS

| | | |
|---|---|---|
| 4,018,385 | 4/1977 | Bruno . |
| 4,026,470 | 5/1977 | Crist . |
| 4,073,438 | 2/1978 | Meyer . |
| 4,117,979 | 10/1978 | Lagarelli et al. . |
| 4,457,343 | 7/1984 | Zukausky . |
| 4,478,367 | 10/1984 | Petursson . |
| 4,487,368 | 12/1984 | Clearman . |
| 4,508,144 | 4/1985 | Bernett . |
| 4,542,853 | 9/1985 | Diamond . |
| 4,629,404 | 12/1986 | Raymond . |
| 4,754,925 | 7/1988 | Rubinstein . |
| 4,801,091 | 1/1989 | Sandvik . |
| 4,802,628 | 2/1989 | Dautel et al. . |
| 4,828,179 | 5/1989 | Garner . |
| 4,838,486 | 6/1989 | Finkbeiner . |
| 4,933,999 | 6/1990 | Mikiya et al. . |
| 4,944,457 | 7/1990 | Brewer . |
| 4,951,877 | 8/1990 | Arsi . |
| 4,989,786 | 2/1991 | Kranzle et al. . |
| 5,058,220 | 10/1991 | Mikiya . |
| 5,108,035 | 4/1992 | Friedrichs . |
| 5,141,153 | 8/1992 | Jeffress . |
| 5,163,615 | 11/1992 | Bauer . |
| 5,201,468 | 4/1993 | Freier et al. . |
| 5,217,166 | 6/1993 | Schulze et al. . |
| 5,248,092 | 9/1993 | Rankin . |
| 5,294,054 | 3/1994 | Benedict et al. . |
| 5,316,216 | 5/1994 | Cammack et al. . |
| 5,328,097 | 7/1994 | Wesch et al. . |
| 5,332,155 | 7/1994 | Jager . |
| 5,381,960 | 1/1995 | Sullivan et al. . |
| 5,395,053 | 3/1995 | Frech . |
| 5,439,174 | 8/1995 | Sweet . |
| 5,467,927 | 11/1995 | Lee . |
| 5,504,955 | 4/1996 | Mueller et al. . |
| 5,507,053 | 4/1996 | Mueller et al. . |
| 5,518,181 | 5/1996 | Shames et al. . |
| 5,551,635 | 9/1996 | Jager . |
| 5,577,664 | 11/1996 | Heitzman . |
| 5,588,595 | 12/1996 | Sweet et al. . |
| 5,598,975 | 2/1997 | Jager . |
| 5,671,885 | 9/1997 | Davisson . |
| 5,697,392 | 12/1997 | Johnson et al. . |
| 5,704,547 | 1/1998 | Golan et al. . |
| 5,722,592 | 3/1998 | Jager . |
| 5,810,257 | 9/1998 | Ton . |
| 5,918,811 | 7/1999 | Denham et al. . |

* cited by examiner

SINGLE CHAMBER SPRAY HEAD WITH MOVING NOZZLE

BACKGROUND OF THE INVENTION

This application claims benefit of provisional application 60/108,627 filed Nov. 16, 1998.

FIELD OF THE INVENTION

The present invention relates to a fluid discharging apparatus that provides a wobbling motion.

BACKGROUND OF THE RELATED ART

Showerheads, faucets and other spray heads or nozzles are commercially available in numerous designs and configurations. While many showerheads and faucets are designed and sold for their decorative styling, there is a great number of different showerhead mechanisms which are intended to improve or change a characteristic of the water spray pattern. Any particular spray pattern may be described by the characteristics of spray width, spray distribution or trajectory, spray velocity, and the like. Furthermore, the spray pattern may be adapted or designed for various purposes, including a more pleasant feeling to the skin, better performance at rinsing, massaging of muscles and conservation of water, just to name a few.

The vast majority of spray heads may be categorized as being either stationary or oscillating and having either fixed or adjustable openings or jets. Stationary spray heads with fixed jets are the simplest of all spray heads, consisting essentially of a water chamber and one or more jets directed to produce a constant pattern. Stationary spray heads with adjustable jets are typically of a similar construction, except that some adjustment of the jet direction, jet opening size and/or the number of jets utilized is facilitated. For example, a showerhead typically used in new residential home construction provides a stationary spray housing having a plurality of spray jets disposed in a circular pattern, wherein the velocity of the spray is adjustable my manually rotating an adjustment ring relative to the spray housing.

These stationary spray heads cause water to flow through its apertures and traverse essentially the same path in a repetitive fashion, such as a showerhead jet directing water at a fixed position on a person's skin. The user of such a showerhead feels a stream of water continuously on the same area and, particularly at high pressures or flow rates, the user may sense that the water is drilling into the body, thus diminishing the positive effect derived from such a shower head. In order to reduce this undesirable feeling from showerheads, and to improve the water distribution from spray heads generally, various attempts have been made to provide oscillating spray heads.

Examples of oscillating showerheads are disclosed in U.S. Pat. Nos. 3,791,584 (Drew et al.), 3,880,357 (Baisch), 4,018,385 (Bruno), 4,944,457 (Brewer), and 5,577,664 (Heitzman). U.S. Pat. No. 4,944,457 (Brewer) discloses an oscillating showerhead that uses an impeller wheel mounted to a gear box assembly which produces an oscillating movement of the nozzle. Similarly, U.S. Pat. No. 5,577,664 (Heitzman) discloses a showerhead having a rotary valve member driven by a turbine wheel and gear reducer for cycling the flow rate through the housing between high and low flow rates. Both of these showerheads require extremely complex mechanical structures in order to accomplish the desired motion. Consequently, these mechanisms are prone to failure due to wear on various parts and mineral deposits throughout the structure.

U.S. Pat. No. 3,691,584 (Drew et al.) also discloses an oscillating showerhead, but utilizes a nozzle mounted on a stem that rotates and pivots under forces places on it by water entering through radially disposed slots into a chamber around stem. Although this showerhead is simpler than those of Brewer and Heitzman, it still includes a large number of pieces requiring precise dimensions and numerous connections between pieces. Furthermore, the showerhead relies upon small openings for water passageways and is subject to mineral buildup and plugging with particles.

U.S. Pat. No. 5,467,927 (Lee) discloses a showerhead with a turbine having a plurality of blades designed to produce vibration and pulsation. One blade is provided with an eccentric weight which causes vibration and an opposite blade is provided with a front flange which cause pulsation by momentarily blocking the water jets. Again, the construction of this showerhead is rather complex and its narrow passageways are subject to mineral buildup and plugging with particulates.

U.S. Pat. No. 5,704,547 (Golan et al.) discloses a shower head including a housing, a turbine and a fluid exit body, such that fluid flowing through the turbine causes rotation of the turbine. The rotating (spinning) turbine can be used to cause rotation of the fluid exit body and/or a side-to-side rocking motion in a pendulum like manner.

U.S. Pat. No. 4,073,438 (Meyer) discloses a sprinkler head having a housing with an inlet, a water distributing structure having a nozzle on one end and a cup shaped element at the opposite end which is operative in response to the tangential flow of water into the housing for effecting the orbital movement of the nozzle. There is also disclosed a disk that rotates in rolling contact with a surface within the housing for effecting the fractional rotation of the nozzle. The cup shaped element rotates about the longitudinal axis in response to the tangential flow of water from the inlet.

A particularly useful action for a showerhead is referred to as "wobbling." The term "wobbling" may be defined as the motion of a circular member rolling on its edge along a surface following a circular path. A common example of wobbling is what occurs when a coin is spun on its edge over a smooth surface. The coin begins spinning or rotating in an vertically upright position, but as the coin slows, the coin begins to wobble along a circular path having an ever increasing diameter until the coin comes to rest on its face. While a wobbling motion will often be accompanied by some degree of rotation, a wobbling member will have points on its surface which experience a sequence of up and down motions as well.

Referring to FIG. 1, U.S. Pat. No. 3,091,400 (Aubert) discloses a dishwashing machine having a rotary wobble spraying apparatus comprising a spraying body having a spraying head and a bearing piece, together with a ring surrounding it. The wobble spraying apparatus 10 comprises body piece 12, having a spraying head 14 attached thereto, and a ring 16 surrounding it. The body piece 12 has an internal conical bearing seat 18 and is placed on a water supply pipe 20 having a rounded edge forming a bearing seat 22. The extending piece 12 has a collar 24 pulled down over the supply pipe 20 and an adjoining, outwardly projecting shoulder 26 engages the lower side of ring 16 and rolls on it when water is supplied under pressure. Water supplied through pipe 20 enters a distribution chamber 28 and emerges through the spraying apertures 30 of spraying head 14. The orientation of the apertures 10 is chosen so that a moment of momentum sets the spraying body into rotation, whereby the shoulder 26 of body 12 rolls on the ring 16 as indicated at point 32.

A primary disadvantage of Aubert is that the wobbling motion is caused by the tangential orientation of the apertures in the spray head, thereby limiting the choice of spray patterns. Specifically, the tangential apertures will form a very wide spray pattern that may be useful for dishwashing, but is very undesirable for a showerhead. Furthermore, because of the mass of the spray head 14 and the annular contact between the shoulder 26 and the ring 16, the water supply must be run at a high velocity and pressure before the spray head will begin wobbling.

U.S. Pat. Nos. 2,639,191 and 3,357,643 (both Hruby) discloses a sprinkler and fountain devices having an elongate tubular stem received by a bushing inside an elongate tubular body, wherein the bushing provides sufficient clearance with the stem to allow the stem to gyrate or wobble inside an elongate tubular body. However, this device also relies upon a tangential flow of fluid to actuate the stem. Furthermore, the stem and body are so long that the device would not be suitable for many applications.

U.S. Pat. No. 3,009,648 (Hait) discloses a sprinkler head having a single piece nozzle secured to a fluid conduit, where the nozzle has an inverter cone plug supported in position by struts. The plug includes a plurality of vanes to induce a rotary motion on the nozzle. The sprinkler distributes water in a rotating stream.

U.S. Pat. Nos. 5,439,174 and 5,588,595 (Sweet) as well as U.S. Pat. No. 5,671,885 (Davisson) disclose nutating sprinklers having a body portion with a nozzle at one end and a spray plate supported thereon at an opposite end downstream of the nozzle. The spray plate has a plurality of stream distributing grooves formed on one side thereof configured to cause the spray plate to rotate when struck by a stream emitted from the nozzle. The spray plate has a shaft coupled to the body via a ball and cage, a bearing cage or a flexible connector, respectively.

However, there remains a need for an improved spray head, showerhead or other fluid discharging apparatus that delivers fluid, such as water, in a uniform fashion such that the droplet path is continually changing over time. It would be desirable if the spray head were able to deliver water in the desired manner, even at low pressures or flow rates suitable for use in showerheads and sink faucets. The apparatus would preferably cause minimal pressure drop and deliver fluid in a directional spray pattern. It would be further desirable if the spray head provided a simple and compact design and construction with minimal parts.

SUMMARY OF THE INVENTION

The present invention provides a fluid discharging apparatus, such as a spray head, having a body with a fluid inlet and a wobble turbine engaged with the body downstream of the fluid inlet and in an axially spaced relationship to the fluid inlet. The wobble turbine is provided with a plurality of stream distributing members formed on one side thereof configured to cause the wobble turbine to rotate when struck by a stream emitted from the fluid inlet. The apparatus also includes a deflector disposed to downwardly redirect the distributed stream. The deflector may be either stationary or allowed limited movement in any number of ways. Furthermore, the deflector may be secured to the body or the wobble turbine or it may be allowed to wobble or rotate independently of the wobble turbine. The wobble turbine preferably engages the body in a post and sleeve relationship, for example a post extending from the wobble turbine and a sleeve supported by the body or a sleeve extending from the wobble turbine and a post supported by the body. However, other connections known in the art to allow a wobbling motion may be substituted therefor. The preferred wobble turbine has a conical upper surface, most preferably a concave conical surface, with angular momentum inducing members formed therein, such as grooves, vanes, blades and combinations thereof.

In another embodiment, the invention provides a fluid discharging apparatus comprising a tubular fluid inlet defining space limiting means and a spray housing having an annular wobble plate freely mounted on the fluid inlet between the space limiting means. A wobble turbine engages the spray housing downstream of the fluid inlet in an axially spaced relationship to the fluid inlet, wherein the wobble turbine has a plurality of stream distributing members formed on one side thereof configured to cause the wobble turbine to rotate when struck by a stream emitted from the fluid inlet. A deflector is disposed to downwardly redirect the distributed stream of fluid coming off the wobble turbine. Preferably, the wobble turbine is engaged in a post and sleeve relationship with the spray housing.

In yet another embodiment, the invention provides a fluid discharging apparatus comprising a body having a fluid inlet and a wobble turbine in an axially spaced relationship to the fluid inlet, the wobble inducing member engaged with the body in a post and sleeve relationship located downstream of the fluid inlet.

Optionally, the wobble turbine may define a bore extending longitudinally therethrough, where the sleeve defines a bore therethrough that is in rough alignment with the bore through the wobble turbine. Preferably, the sleeve has a sliding element for selectively opening and closing the bore through the sleeve.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are, therefore, not to be considered limiting of its scope, because the invention may admit to other equally effective embodiments.

DETAILED DESCRIPTION OF THE INVENTION

Figure 1:
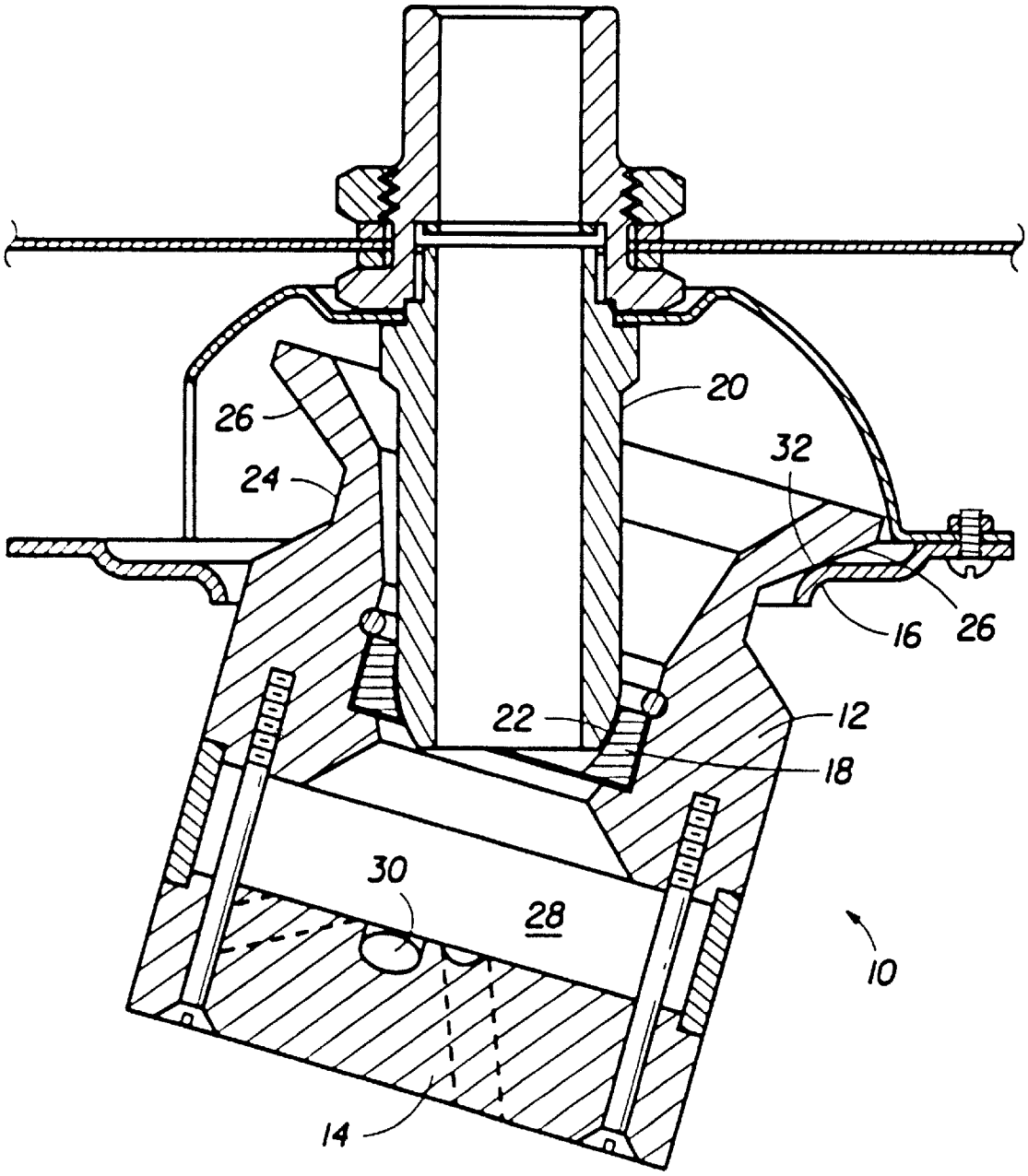
FIG. 1 (PRIOR ART)
FIG. 1 is a cross-sectional side view of a prior art spray head for use in dishwashers.

The present invention provides a fluid discharging apparatus that delivers fluid in a substantially uniform spray distribution. The movement of the apparatus is a wobbling motion, preferably combined with some rotational motion. The wobbling motion is generated by supporting a wobble inducing member or wobble turbine in the path of the fluid supply with a body member, perhaps including frames, beams, a housing, and/or other structural members. Unlike typical aperture-based nozzles, the body does not need to contain pressure or be fluid tight and may, in fact, be substantially open. The water flowing over the wobble turbine causes the wobble turbine to rotate and wobble. The wobbling turbine then effects the direction of the spray pattern exiting the spray nozzle, distributing the fluid in a rotating pattern about the axis of the apparatus. The distributed stream of fluid coming off the wobble turbine is intercepted by a deflector and redirected downward. The pitch of the wobble turbine and the deflector are chosen to minimize the fluid stream's loss of momentum. In accordance with the invention, the deflector may be provided in any suitable manner, such as an integral part of the body or wobble turbine or as a separate component altogether.

The spray pattern produced by the wobbling turbine changes more or less rapidly so that fluid droplets or streams are directed along arcuate paths over time rather than continuously at a single point. This type of spray distribution pattern is gentler than many stationary patterns and the unique design of the wobble turbine does not include complex mechanical parts or significant flow restrictions. For certain applications, it may be desirable to incorporate dividers onto the deflector in order to split the flow of fluid into a plurality of discrete fluid streams.

Another embodiment of the present invention provides a fluid discharging apparatus with a wobble inducing member or wobble turbine that causes the body or housing that supports the wobble inducing member or turbine to also wobble. More particularly, the wobble inducing member is positioned in loose contact with the body or housing of the apparatus, thus reducing the number of parts necessary to achieve such motion and increasing the ability of the apparatus to produce a desired spray width and pattern, such as for a residential shower or faucet. The fluid is distributed off the surface of the wobble turbine in a rotating pattern and then travels without flow restriction over the deflector downward to the outlet of the apparatus, which outlet may be substantially open or may include non-restrictive dividers or channels of any number and configuration. As used herein, the term "downward" or "downwardly" means that the fluid distributed off the wobble turbine at a first angle relative to the axial centerline of the fluid inlet is deflected so that the fluid changes its direction to a second smaller angle relative to the axial centerline of the fluid inlet.

While the wobble turbine may conceivable distribute fluid at a first angle that is anything less than 90 degrees, the turbine should distribute fluid at an angle less than 60 degrees from axial, preferably less than 45 degrees from axial, and most preferably between about 30 and about 40 degree from axial. The deflector should receive or intercept the distributed fluid from the turbine with a surface angled similar to the first angle at which the fluid is distributed off the turbine. Further, while the deflector may redirect the fluid at many angles, even angles toward the axial centerline instead of angles away from axial, the deflector should have a smooth, gradually changing slope to redirect fluid into a tighter fluid discharging pattern than a given turbine would have otherwise provided. Preferably, the deflector will redirect the fluid at an angle within about ±20 degrees of a line parallel to the axial centerline, and even more preferably the deflector will redirect fluid at two or more angles, such as having twelve channels 66 with four of them angled at 0 degrees and the other eight angles at 10 degrees. It should be recognized that since the turbine wobbles and certain embodiments of the deflector will wobble either dependent or independent of the wobble turbine that the relative angles and combinations of angles of the turbine and deflector are constantly changing and are further dependent upon the degree of wobble allowed by the design of their connections, i.e., a post and sleeve dimensions or an annular wobble plate and space limiting member, etc. Finally, the turbine and deflector surfaces are preferably concave in order to achieve a gradual transition of the direction in which the water stream is going with no more than minimial loss of momentum and without excessive splashing or misting of the water.

Preferably, the wobble inducing member or wobble turbine is disposed in direct engagement or contact with the body of the apparatus. More particularly, the body member supports the wobble turbine in an axially spaced relationship with the fluid inlet, whether that support entails a mechanical linkage, such as a flexible connector or ball and cage type arrangement, or a loose male-female relationship, such as the most preferred post and sleeve relationship. The term "post and sleeve relationship", as used herein, includes any of a number of configurations where a post (male connector), forming an outer cylindrical, conical or frustoconical surface, is received loosely within a sleeve (female connector), forming a inner cylindrical, conical or frustoconical surface, to allow the wobbling to occur therebetween. The bottom surface of the post is preferably rounded or otherwise formed to minimize friction and binding between the members. It should be recognized that the sleeve may be formed as an integral part of the body or housing and the post may be part of the wobble inducing member or vice versa. It is preferred to design the post and sleeve with sufficient tolerances therebetween so that the wobble inducing member can wobble in relation to the body or housing without binding. Furthermore, it is most preferred to utilize a post and sleeve relationship having a conical or frustoconical surface on at least a portion of the post with a first diameter for rolling engagement with a conical or frustoconical surface on at least a portion of the sleeve having a slightly greater diameter supported in an axial spaced relationship with the fluid outlet. The conical or frustoconical surfaces should have a common apex in order to for the surfaces to come into full rolling contact.

One advantage of the post and sleeve relationship of the wobble inducing member or wobble turbine to the body is that there is very little friction or other forces to be overcome before the wobble turbine will begin wobbling. In this manner, the initiation and maintenance of a wobbling motion of the present invention is substantially independent of fluid flow rate and operates very effectively in shower heads and faucets even at flow rates much lower than the 2.5 gallons-per-minute maximum imposed by the laws of many states.

A second advantage of the post and sleeve relationship is that the wobble turbine is easily cocked, shifted or tilted away from the axial centerline of the fluid inlet. In fact, even when no fluid is being passed through the spray head assembly, the wobble turbine may rest at a tilted angle relative to the axial centerline of the fluid inlet. In order to provide the most effective wobbling motion, it is preferable for the wobble turbine to be shifted sufficiently away from the axial centerline of the fluid inlet so that a major portion of the fluid delivered through the fluid inlet is being directed at only one side of the wobble turbine face at any given point in time. The loose-fitting post and sleeve relationship allows the fluid discharging apparatus of the present invention to achieve a sufficient shifting of the wobble turbine within a much shorter longitudinal distance (the distance measured along the axial centerline from the fluid inlet to the fluid outlet) with fewer parts.

The wobble turbine may be supported by the body, frame or housing of the apparatus in any configuration, but is preferably support with a series of thin fins, preferably three or four, extending radially from the body, frame or housing wall positioned below the outlet channels. The use of thin fins is generally sufficient to support the wobble turbine without providing any significant restriction to the overall flow of fluid. Alternatively, the wobble turbine may be supported by a single arm extending along one side of the apparatus.

The apparatus has exhibited the ability to operate with a reduced water flowrate while providing a satisfying stream of water that is particularly useful in a sink faucet. Because of the wobbling action, the distribution or coverage of fluid discharged out of the apparatus onto a surface is extremely uniform and may be characterized as a rotonutational fluid distribution as set out in U.S. patent application Ser. No. 09/115,362, which is incorporated herein by reference. Therefore, the distribution pattern allows the apparatus to have fewer and less restrictive channels having greater cross-sectional area that is less likely to become restricted or plugged with lime, other minerals or particles.

While the degree of wobbling is generally limited by the tolerances between a post and sleeve or between an wobble plate and a space limiting member, the apparatus may optionally further include an active wobble limiting member. The spray width of an apparatus of the present invention is determined by the both the angle of the outlet channels relative the central axis of the apparatus and the angle of deflection imparted on the outlet channels, if any, due to wobbling. For example, if the outlet channels from the deflector provided a 6° spray width during use in a stationary mode and the deflector is designed to wobble at an angular deflection of 5° on either side of the axial center, then the effective spray width during use in a wobbling mode in accordance with the present invention would be about 16° (5° additional width in all directions). Therefore, the wobble limiting member plays an important role in determining the effective spray width of the spray nozzle as well as the extent of the arcuate path that each fluid stream traverses during a single wobble. An active wobble limiting member, such as a tracking ring, operates as a self centering mechanism for the wobble turbine.

It should be recognized that the apparatus of the present invention, and the individual components thereof, may be made from any known materials, preferably those materials that are resistant to chemical and thermal attack by the fluid passing therethrough. Where the fluid is water, the preferred materials include plastics, such as one or more injection moldable or extrudable polymer materials, most preferably an acetal resin, and metals or metal alloys, such as stainless steel. Other and further materials suitable for use in the present invention should be apparent to one of skill in the art and are considered to be within the scope of the present invention.

Figure 2:
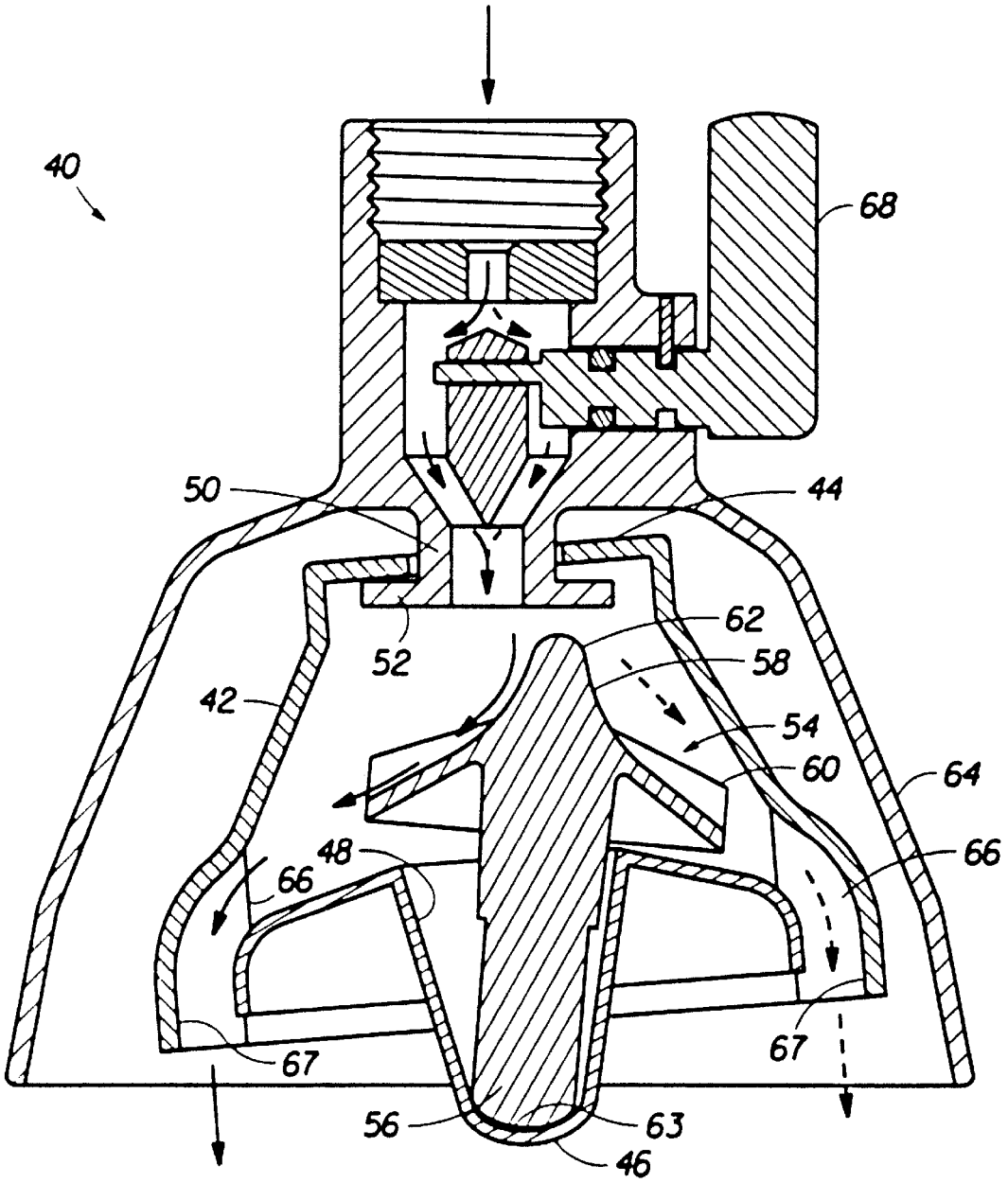
FIG. 2 is a cross-sectional side view of a first embodiment of a fluid discharging apparatus of the present invention.

FIG. 2 is a cross-sectional side view of one embodiment of an apparatus 40 of the present invention. The apparatus 40 has a housing 42 with an upper end defining an inwardly extending annular wobble plate or collar 44 and a lower end supporting a sleeve 46 having a generally frusto-conical inside surface 48 that opens toward the upper end of the housing. The apparatus includes a water inlet 50 which defines an annular flange 52 adapted to receive the collar 44 of the housing 42. A wobble turbine 54 has a lower end or post 56 positioned inside the sleeve 46. The inside surface 48 of the sleeve 46 has a slightly larger inner diameter over most of its length than the outer diameter of the lower end or post 56 of the wobble turbine and a rounded lower end.

The wobble turbine 54 has an upper surface 58 that is generally conical in shape and forms a plurality of angular momentum inducing vanes 60 extending therefrom. In accordance with the present invention, grooves and vanes may be used substantially interchangeably to accomplish the same objective. However, it is expected that thin profile vanes will transfer suitable wobble inducing forces to the turbine while shedding fluid off the turbine surface at one single angle defined by the conical surface between the vanes. By contrast, a surface having grooves over half of the surface area would shed half the fluid at one angle (say the angle of the groove valleys) and half the fluid at another angle (say the angle of the hills between the grooves).

The upper surface 58 of the wobble turbine 54 preferably forms an annular overhang facing the lower end 56. The lower end 56 is a generally cylindrical post having a rounded bottom surface 63. The conical upper surface 58 is preferably rounded at the apex 62. An optional outer housing 64 may be included for aesthetic purposes, but will preferably not come into contact with the wobbling housing 42. The housing 42 forms an integral deflector 67 with dividers or channels 66. The deflector surface 67 is preferably a smooth arc that gradually redirects the water downward in a uniform flow pattern with minimal loss of momentum.

When assembled, the post 56 of the wobble turbine 54 rests inside the sleeve 46. The wobble turbine and the sleeve may be made from any suitable material, but preferably are made from one or more injection moldable or extrudable polymer materials, most preferably an acetal resin such as DELRIN (a trademark of Du Pont de Nemours, E. I. 7 Co. of Wilmington, Del.). It should be recognized that the wobble turbine and sleeve are in rolling contact and their materials should provide at least some friction as required to produce a consistent wobbling or nutating action, yet not so much friction, particularly at the distal end of the post, as to dissipate the momentum of the water or cause binding of the turbine. The turbine and sleeve preferably contact each other along frustoconical surfaces with the area of contact being a controllable factor in determining the amount of friction therebetween.

In operation, the water flow enters through the water inlet 50 and strikes the top of the wobble turbine 54. The forces of the water stream against the conical surface 58 and and the vanes 60 along with the engagement of the post 56 within the frusto-conical surface 48 induce the wobble motion of the wobble turbine 54 when contacted or struck with a stream of water. The wobbling motion of the wobble turbine 54 imparts a wobbling movement to the housing 42 in which the annular wobble plate 44 of the housing contacts and wobbles about the annular flange 52. Without limiting the scope of the invention, it is believed that when the wobble turbine 54 is made to wobble in a clockwise direction about the centerline of the stream coming from the water inlet 50 that the housing 42 rotates in a counter-clockwise direction about the centerline. The water is directed or distributed to the deflector 67 of the spray housing 42 by the vanes 60.

Also shown in FIG. 2, a flow control means such as a needle valve 68 like the one shown in FIG. 21 of pending U.S. patent application Ser. No. 09/150,480, which application is incorporated by reference herein, may be used to control the flow of water on to the turbine.

Figure 3:
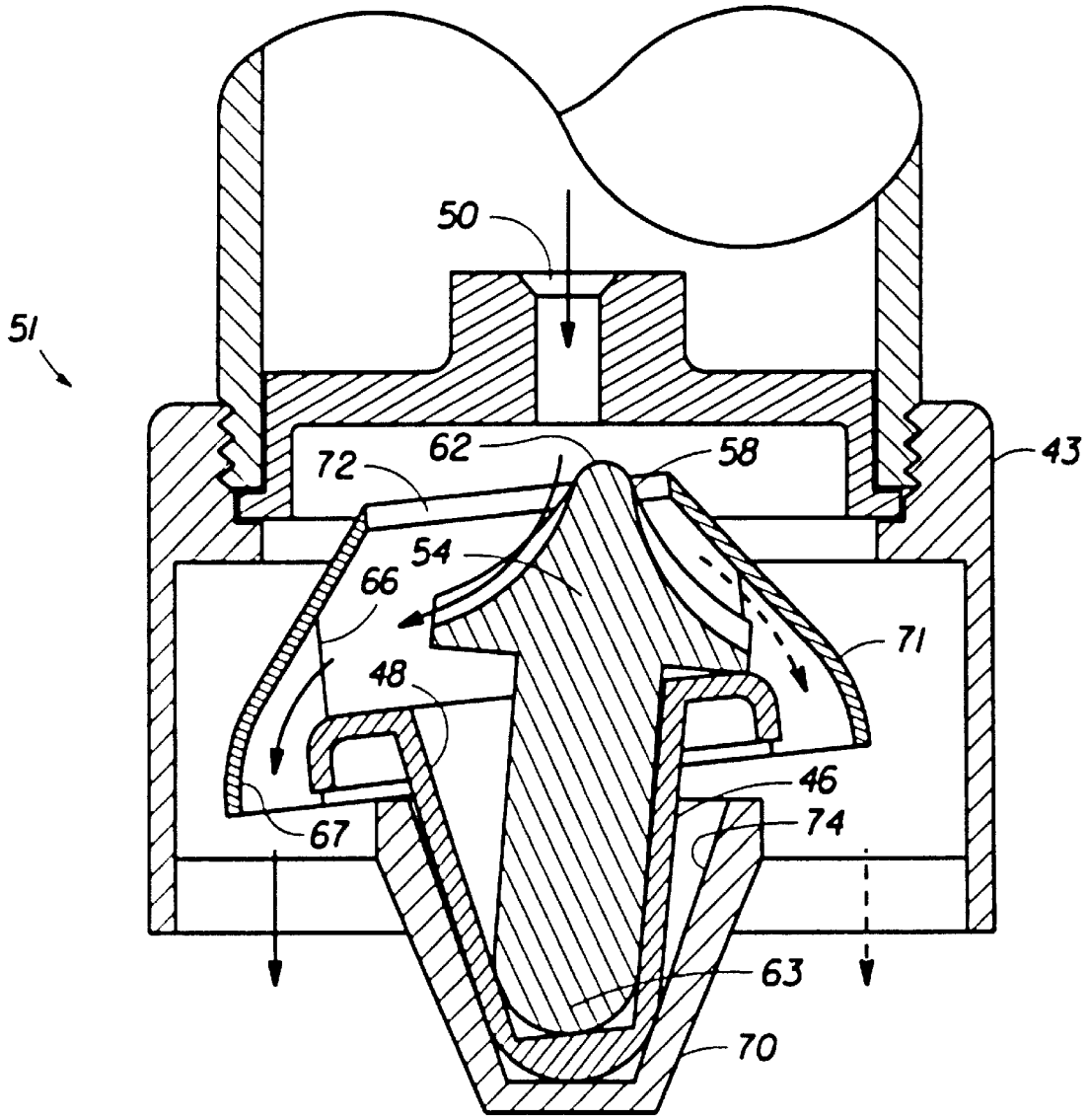
FIG. 3 is a cross-sectional side view of a second embodiment of the present invention.

FIG. 3 is a cross-sectional side view of another embodiment of the present invention, in which elements that are similar to those of FIG. 2 are labeled with the same reference numbers. In this embodiment, the apparatus 51 has a stationary housing 43 that forms and supports a sleeve 70 opposite the water inlet 50 having a frusto-conical inside surface 74 for loosely receiving a sleeve 46 defined by a wobbling deflector 71. The deflector 71 has an upper end 72 that is open and not attached to the water inlet 50 as in FIG. 2. The wobble turbine 54 rests in the sleeve 46 of the deflector 71, while the deflector sleeve 46 rests inside the housing sleeve 70. When fluid strikes the wobble turbine, both the turbine 54 and the deflector 71 wobble.

Figure 4:
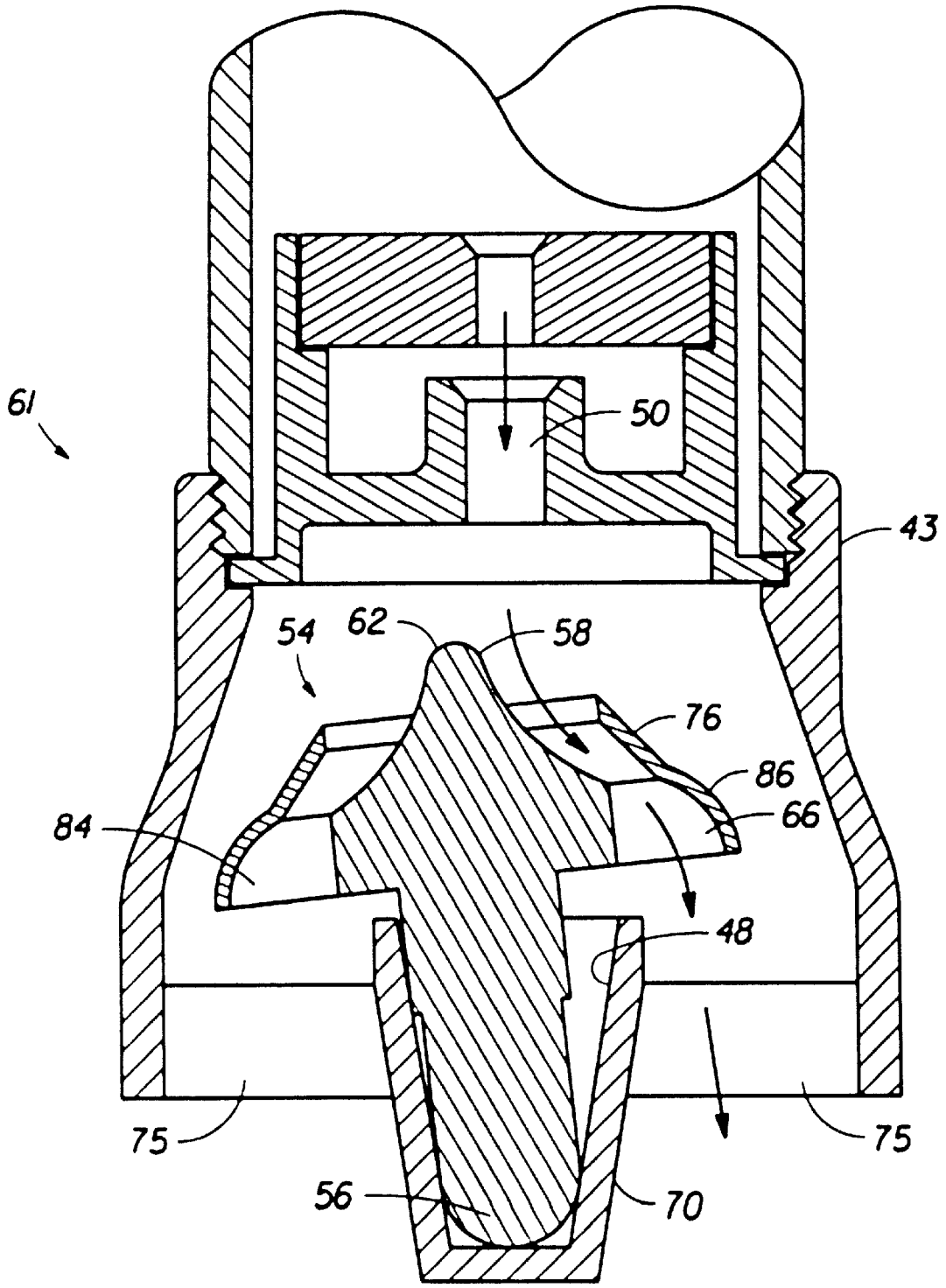
FIG. 4 is a cross-sectional side view of a third embodiment of the present invention.

FIG. 4 is a sectional view of yet another embodiment of the present invention. The apparatus 61 has a stationary housing 43 with a water inlet 50 at the upper end and a plurality of thin, radially extending fins 75 at the lower end extending between the inside wall of the housing 43 and the sleeve 70 to support the sleeve 70 within the spray housing 42. The wobble turbine 54 has a conical upper surface 58 with a plurality of angular momentum inducing vanes 84 extending outwardly from the turbine 54. The opposite end of the vanes 84 are connected to a deflector 86 to form a wheel and spoke type arrangement defining channels 66 therebetween. (See also FIG. 5) The flow channels 66 are formed between the vanes 84 and the deflector 86, where the vanes 84 act to disperse the water flow through the channels 66. The deflector 86 is shown having an optional extended portion 76 extending upwardly from the vanes 84 in order to contain the water flow coming off the turbine and redirect it downwardly through the channels 66.

Figure 5:
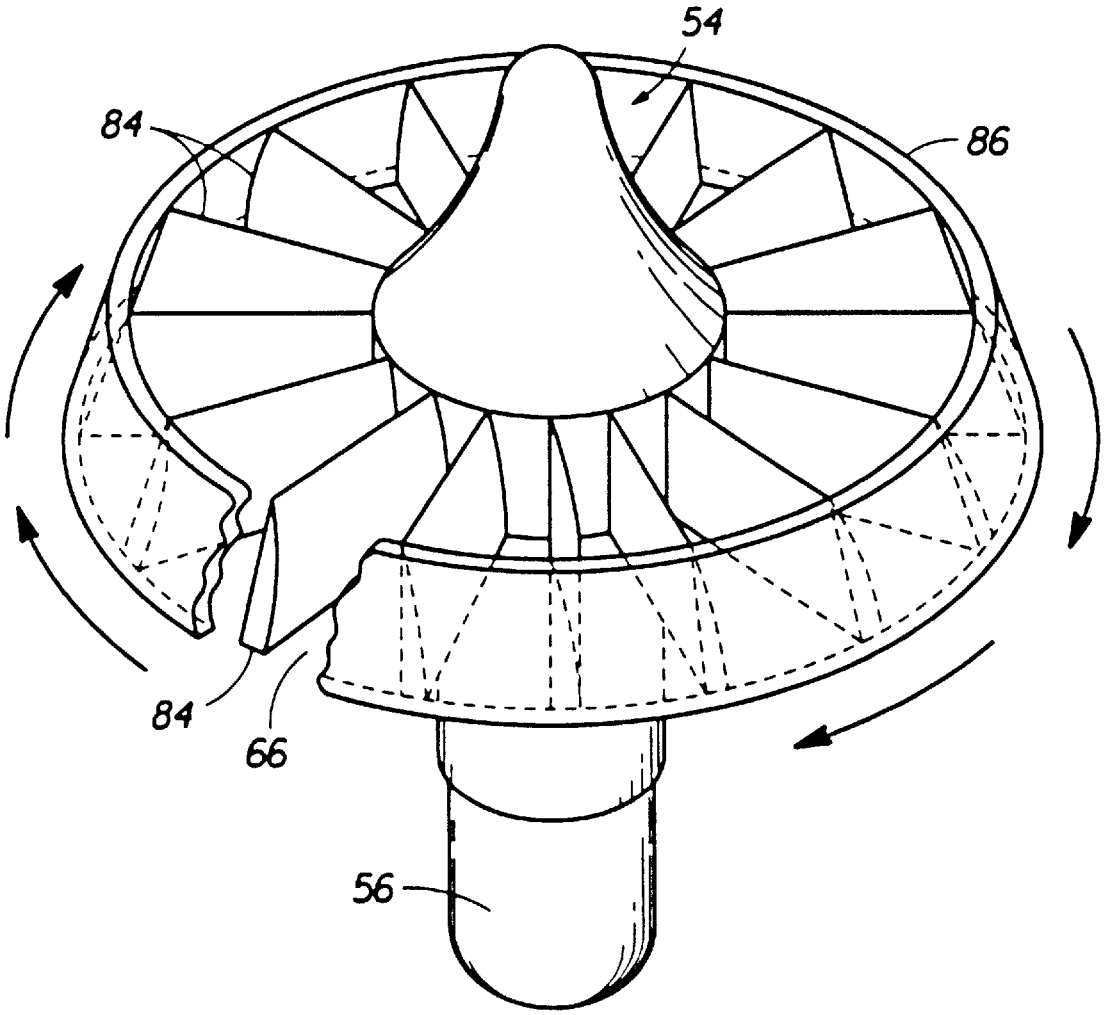
FIG. 5 is a plan view of the apparatus shown in FIG. 4.

FIG. 5 is a perspective view of the turbine 54 shown in FIG. 4 with hidden portions shown in dashed lines and the extended portion 76 of the deflector 86 removed for clarity. Each of the vanes 84 extend radially about the post 56. Preferably, each of the vanes 84 have an angled side surface 90 that imparts a rotational motion on the turbine 54 when contacted with a water stream. The angled side surface 90 preferably forms an angle with the vertical side surface of between 5 and 15 degrees, more preferably about 7 degrees. The pitch of the angle is a important in establishing how fast the turbine will rotate in response to the water stream contacting the vanes. The water hits the top of the vanes and travels down the angled side surface 90, thus pushing the turbine 54 in a clockwise rotational direction (as viewed from the top in the configuration shown, although an alternate configuration could produce a counter-clockwise rotational direction) which produces a counter-clockwise wobble or nutation of the turbine. The mechanics of this motion are described in great detail in the copending U.S. patent application Ser. No. 09/115,362, which is incorporated herein by reference. The vanes work in cooperation with the deflector 86 which has an inner surface that is downwardly opening to direct water at one or more desirable angles.

When the water supply is turned on, water enters the housing 43 and strikes the top of the turbine 58, causing the turbine to tilt to one side and wobble within the sleeve 70. The water is deflected off of the turbine 58 and through the outlet channels 66, thereby striking the vanes and causing the turbine to rotate. The housing 43 supports the sleeve 70, preferably using about 3 or 4 thin, radially extending fins 71 extending from the inside wall of the housing 64 toward the sleeve 70. The turbine immediately begins to wobble and discharge water in a highly uniform distribution.

Figure 6:
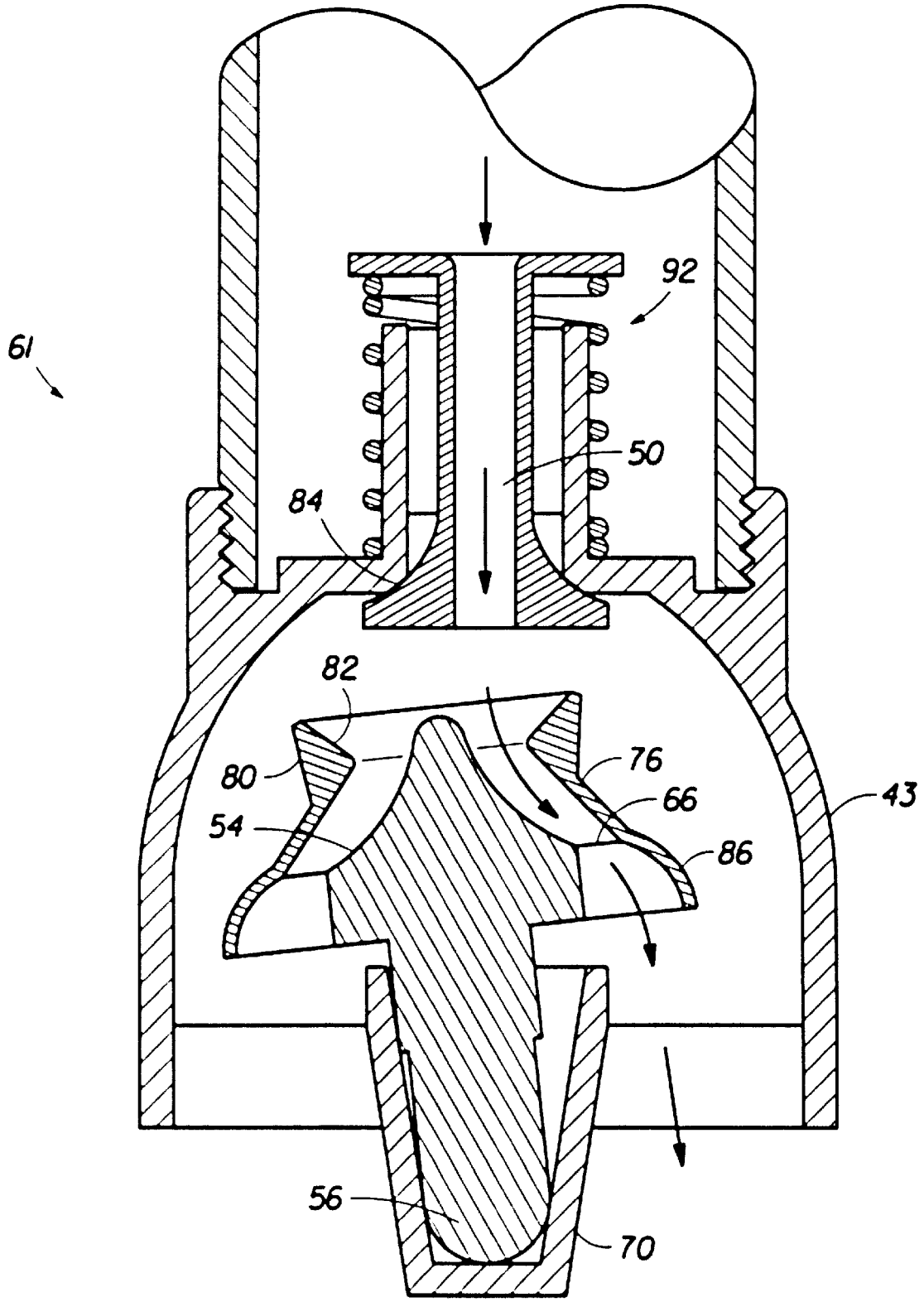
FIGS. 6 and 7 are cross-sectional side views of a fourth embodiment of the present invention.

FIG. 6 is a cross-sectional view of the apparatus 61 similar to the one shown in FIG. 4. The deflector 86 may have a wobble limiting or tracking element 80 which acts to limit the degree to which the wobble turbine tilts in the sleeve 70. The wobble limiting element 80 preferably forms a frusto-conical surface 82 that is inverted with respect to the conical upper surface 58 of the wobble turbine 54 so that when the water flowing from the water inlet 50 impacts the surface 82, the turbine is urged back towards the centerline of the fluid inlet 50.

The fluid discharging apparatus can also be provided with a water control element or bypass 92 which allows additional water to flow through the apparatus. The water control element 92 can consist of a compression spring valve seat 84 that seals against the inside surface of the housing 43 when the valve is in a closed position.

Figure 7:
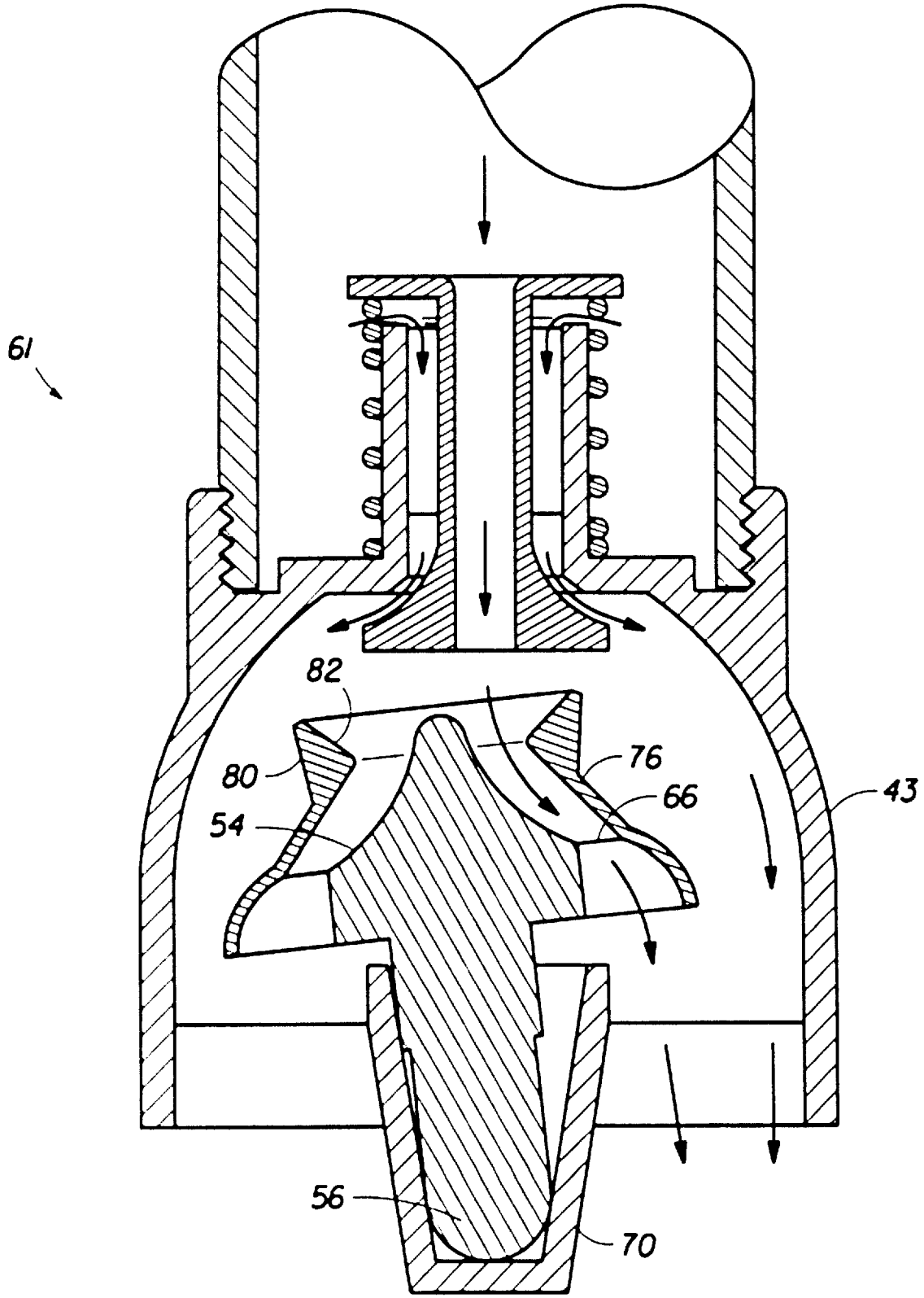

As shown in FIG. 7, if greater water flow is desired, the water pressure supplied to the apparatus may be increased, perhaps by opening a valve (not shown), until the spring is actuated and the seat is disengaged from the inside surface of the housing 43, thus allowing more water to flow through the housing 43. In the configuration shown here, the additional water flow is generally directed against the walls of the housing 43 around the wobble turbine 54 and, therefore, does not significantly affect the degree of wobble experienced by the turbine 54 and the spray housing 42.

Figure 8:
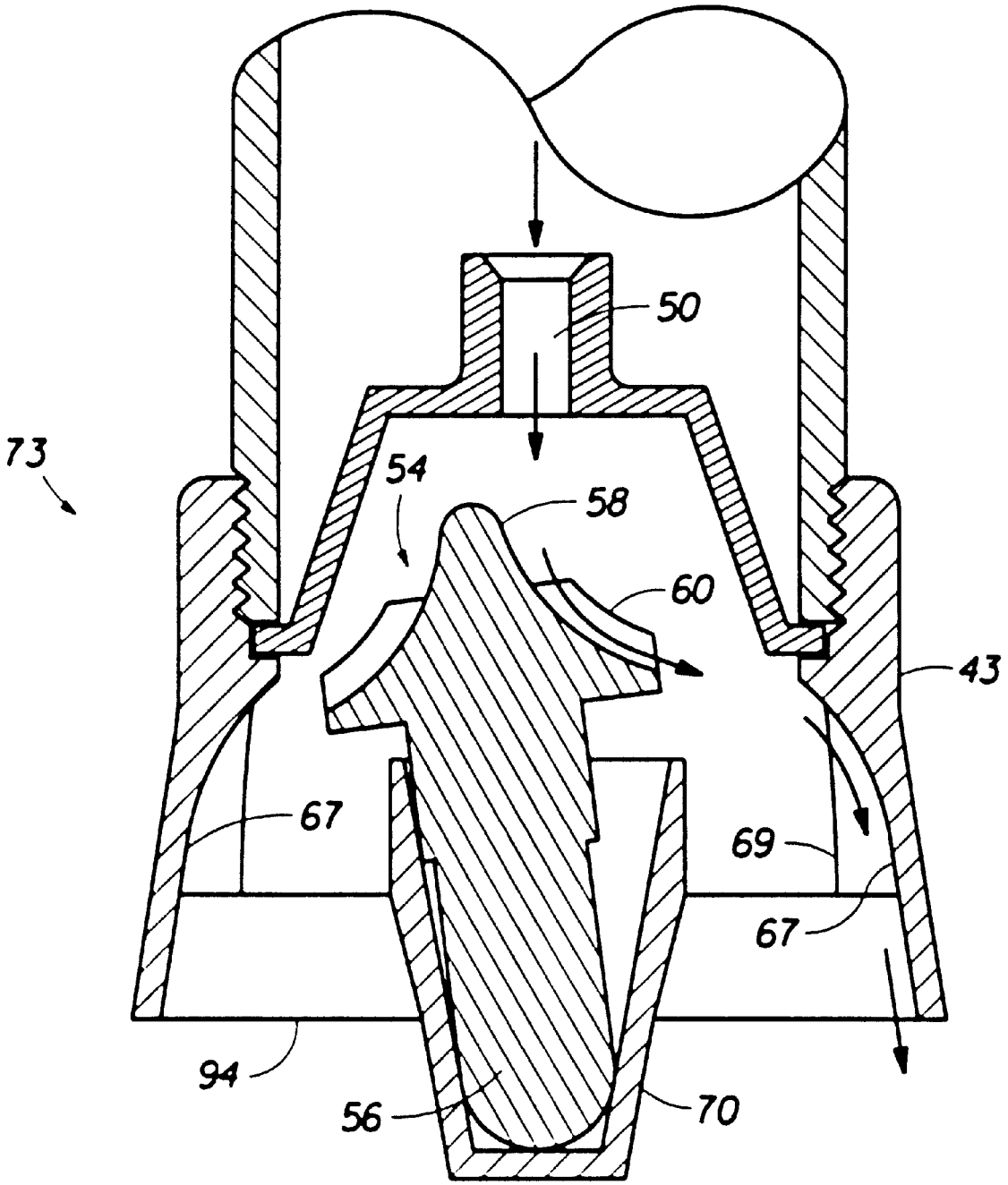
FIG. 8 is a cross-sectional side view of a fifth embodiment of the present invention.

FIG. 8 is a cross-sectional side view of an apparatus 73 similar to the one shown in FIG. 2, except that the body or housing 43 does not wobble and the optional, decorative outer housing 64 has been omitted. The wobble turbine 54 has a conical surface 58 and vanes 60 extending from the upper surface 58 which direct the water flow outwardly against the inner wall 67.

The housing 43 supports the sleeve 70 using a plurality of thin fins 94 extending from the inside surface of the housing 43 to the sleeve 70. The deflector 67 formed on the inner wall of the housing 43 may optionally include ridges or dividers 69 that split the flow of water from the turbine into discrete water streams. Unlike other embodiments of the present invention discussed thus far, the apparatus 73 does not produce a wobbling spray pattern, but still provides a water distribution pattern comprising many finely divided droplets without using small apertures that can become plugged. Another advantage of the present invention compared with current spray heads, is the reduced number if parts required to produce an effective water distribution pattern, such as for showering, hand washing, and the like. It should be noted that the fluid inlet of this embodiment, as well as any of the embodiments described above, may be fitted with a flow control valve to provide a suitable water flow.

Figure 9:
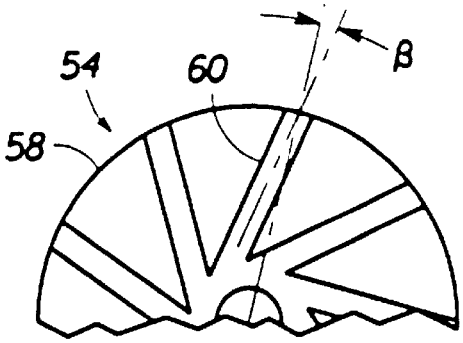
FIGS. 9–11 are schematic views of the top of a wobble turbine of the present invention.
Figure 10:
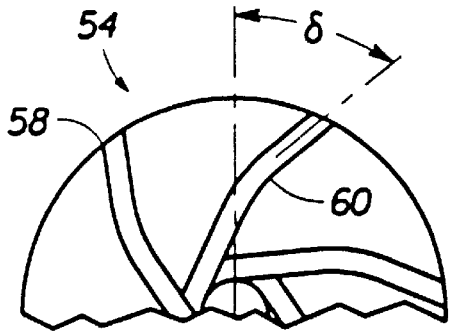
Figure 11:
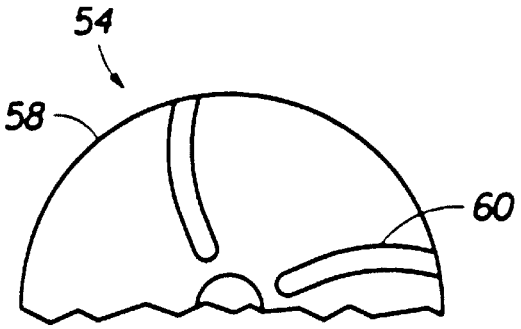

FIGS. 9–11 are top views of various conical top surfaces 58 of the turbine 54 as shown in FIG. 2. The top surface 58 of the wobble turbine 54 is illustrated having vanes 60 formed in a non-radial configuration. It should be noted that fluid flow impacting upon the wobble turbine will push the wobble turbine aside into a tilted position so that the center point of the wobble turbine is substantially out of the stream of fluid from the inlet and only one side of the wobble turbine is aligned with the fluid stream at any point in time. Each of the vanes 60 formed in the upper surface of the wobble turbine 54 are non-radial and cause the wobble turbine 54 to orbit around the fluid inlet 50 as fluid flows against the vanes 60. The non-radial vanes 60, the conical surface and the loose relationship between the post and the sleeve ensure that when fluid flows against the top of the wobble turbine 54 under pressure (even low pressure), the wobble turbine will tilt off center and start to wobble. More particularly, the fluid striking the conical surface 58 of the turbine causes a tilting force and the fluid passing through the vanes 60 causes rotational forces. Therefore, the fluid stream passing through the inlet causes the wobble turbine to wobble.

Once the wobbling motion begins, the continued flow of water maintains the wobble turbine in a wobbling mode. Furthermore, the flow of fluid also causes a hold down force which pushes downward on the turbine, tending to keep the turbine from being displaced from its cooperative relationship with the sleeve. Therefore, it is preferred that the angle of the conical surface 58 be sufficiently great to produce at least a slight tilting force even when the turbine is already fully tilted, yet not so great as to cause the turbine to pull up and out of contact with the sleeve. It should be recognized that each of the embodiments of FIGS. 2 through 12 may be equally effective if the wobble turbine comprises a sleeve (instead of a post) and the spray housing comprises a post (instead of a sleeve) for engaging the wobble turbine sleeve.

For any given wobble turbine, the wobble rate or speed may be increased (or decreased) by increasing (or decreasing) the flow rate of fluid through the spray head. However, it is possible to design the wobble turbine to have a faster or slower wobble rate for a given fluid flow rate by changing the angle or pitch of the grooves or vanes of the wobble turbine or by changing the relative dimensions of the post and sleeve or other like wobbling and wobble limiting members.

Referring to FIG. 9, a wobble turbine may be designed to have a generally slower wobble rate by decreasing the pitch and depth of the vanes, i.e., designing the vanes 60 at a small angle, $\beta$, from radial. Similarly, the wobble turbine may be designed to have a faster wobble rate by increasing the pitch of the vanes, i.e., designing the vanes 60 at a larger angle, $\delta$, from radial, shown in FIG. 10. Furthermore, the number or spacing and size of vanes may also be modified to customize a wobble rate, as shown in FIG. 11 where the vanes 60 are far apart allowing a significant portion of the water to pass over the turbine without impacting one of the thin vanes 100 and, therefore, providing less angular momentum to the turbine.

Figure 12:
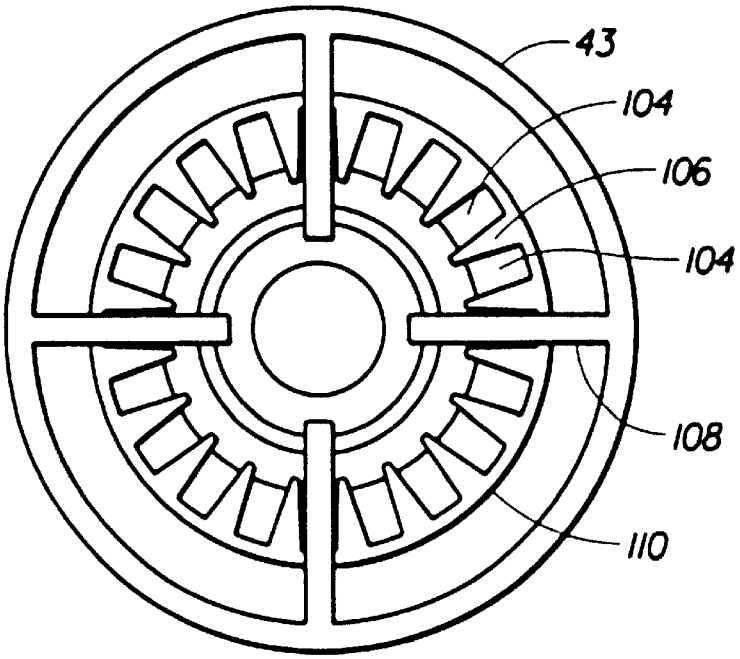
FIG. 12 is a bottom view of a typical apparatus of the present invention showing the outlet channels.

FIG. 12 is a bottom view of the spray heads of FIGS. 3 through 7, showing the outlet channels of the housing. While the outlet channels may be provided in any manner known in the art, a preferred set of outlet channels 104 are defined by a plurality of ribs or dividers 106 connected to the inner surface 110 of the spray housing 42. Four fins 108 are attached to the housing 43 and extend radially inward to support the sleeve 70. It is preferred to direct a minor portion of the outlet channels 104 at a lesser angle to the axis of the spray housing 42 in order to provide more even spray pattern or coverage over an object at a short distance from the spray head, such as a person taking a shower. Lesser angle outlet channels are preferably formed at spaced intervals around the perimeter of the spray nozzle or at locations radially inward toward the central axis of the spray housing (not shown).

Figure 13:
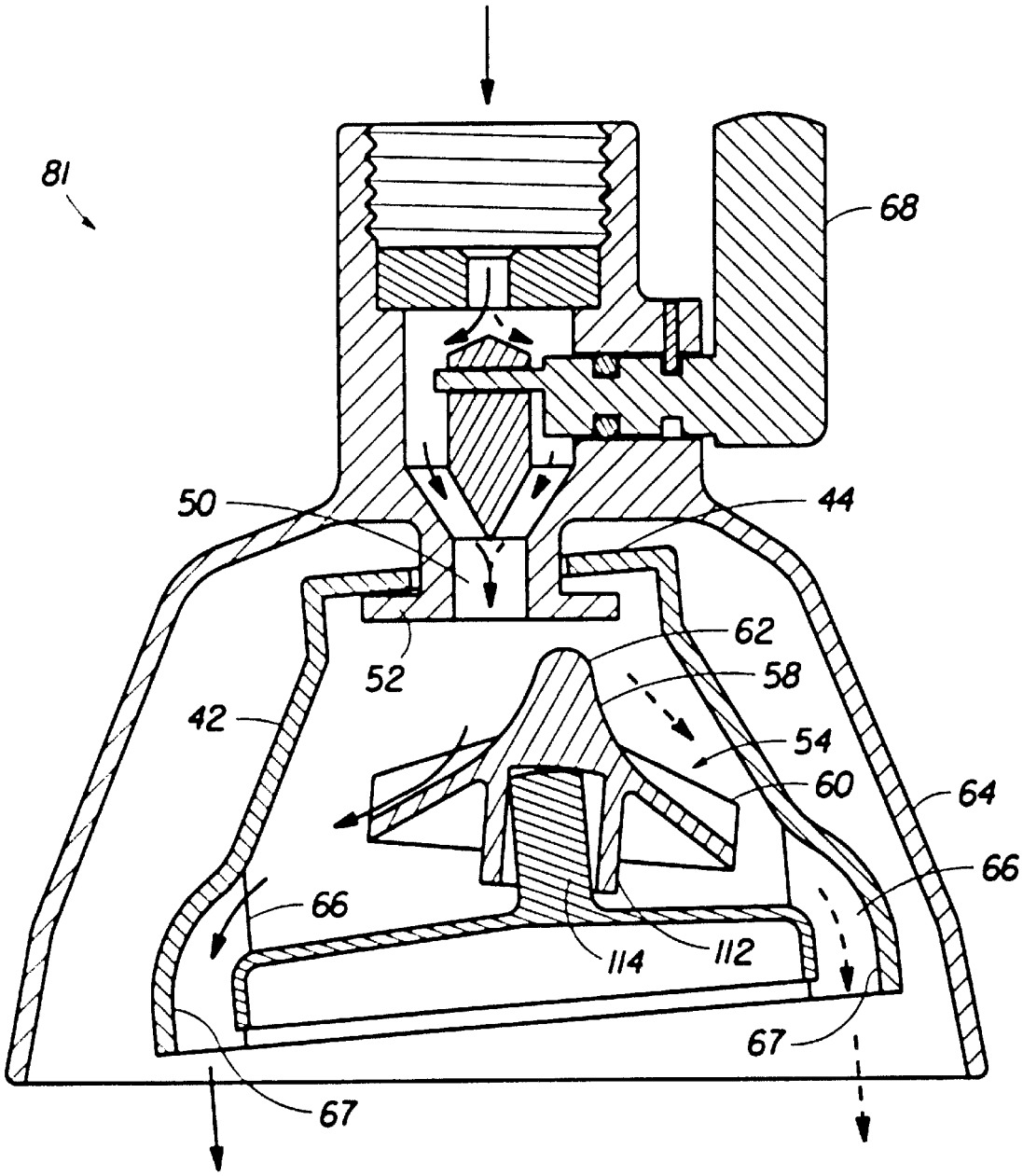
FIG. 13 is a cross-sectional side view of an apparatus similar to that shown in FIG. 2 with the post and sleeve relationship reversed.

FIG. 13 is a cross-sectional side view of an apparatus 81 similar to that shown in FIG. 2. This embodiment includes a post and sleeve relationship between the body 42 and turbine 54, but that relationship is the reverse of the one shown in FIG. 2, in that the wobble turbine 54 forms a sleeve 112 that is loosely received by a post 114, where the post 114 is integral with the spray housing 42. The wobble turbine 54 is contacted by the water from the outlet 50 and tilts in one direction and begin to wobble. In turn, the sleeve 112 contacts the post 114 which causes the housing 42 to tilt and wobble.

Figure 14:
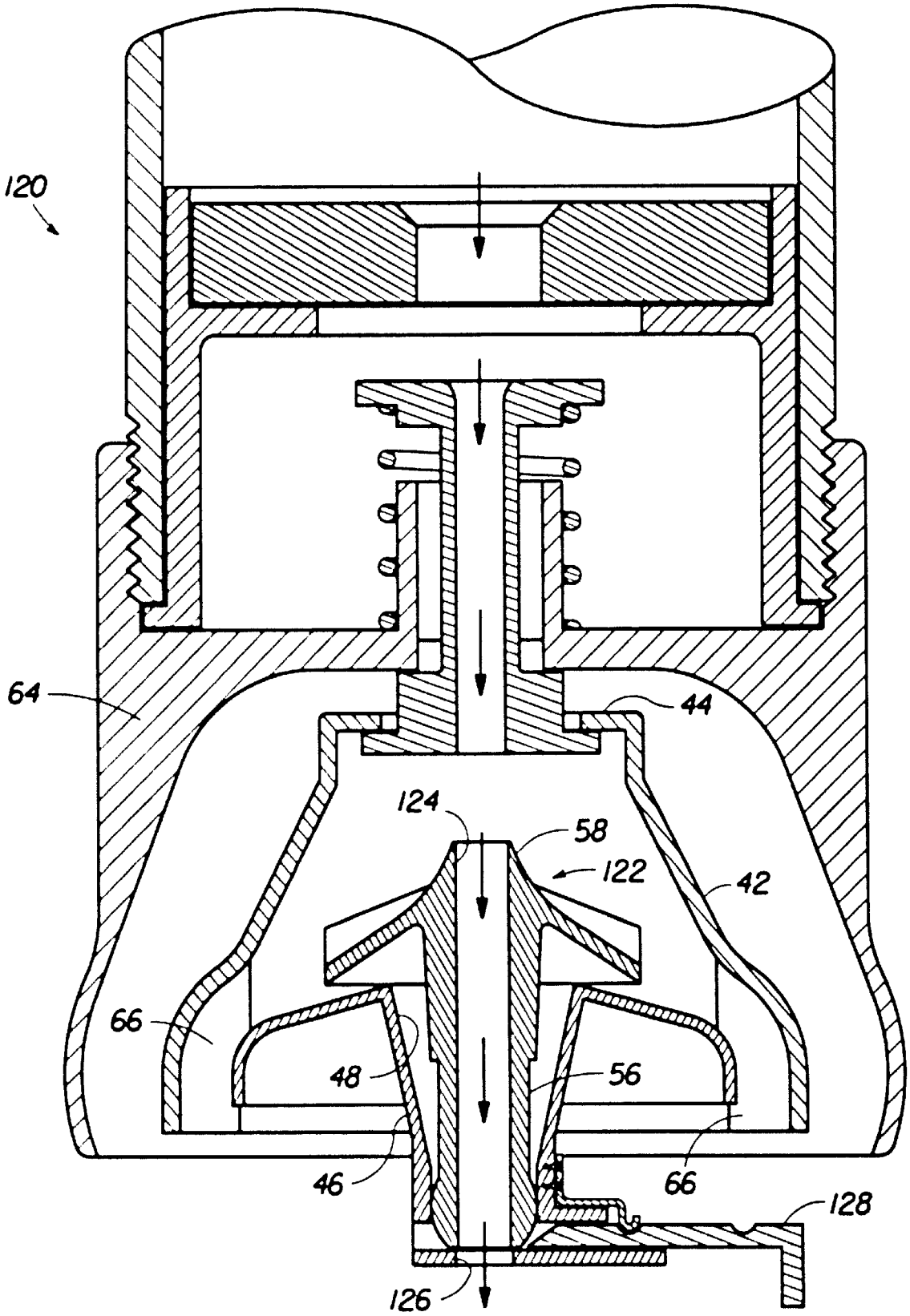
FIGS. 14 and 15 are cross-sectional side views of an apparatus similar to that shown in FIG. 2 with an optional feature providing a concentrated stream of fluid.
Figure 15:
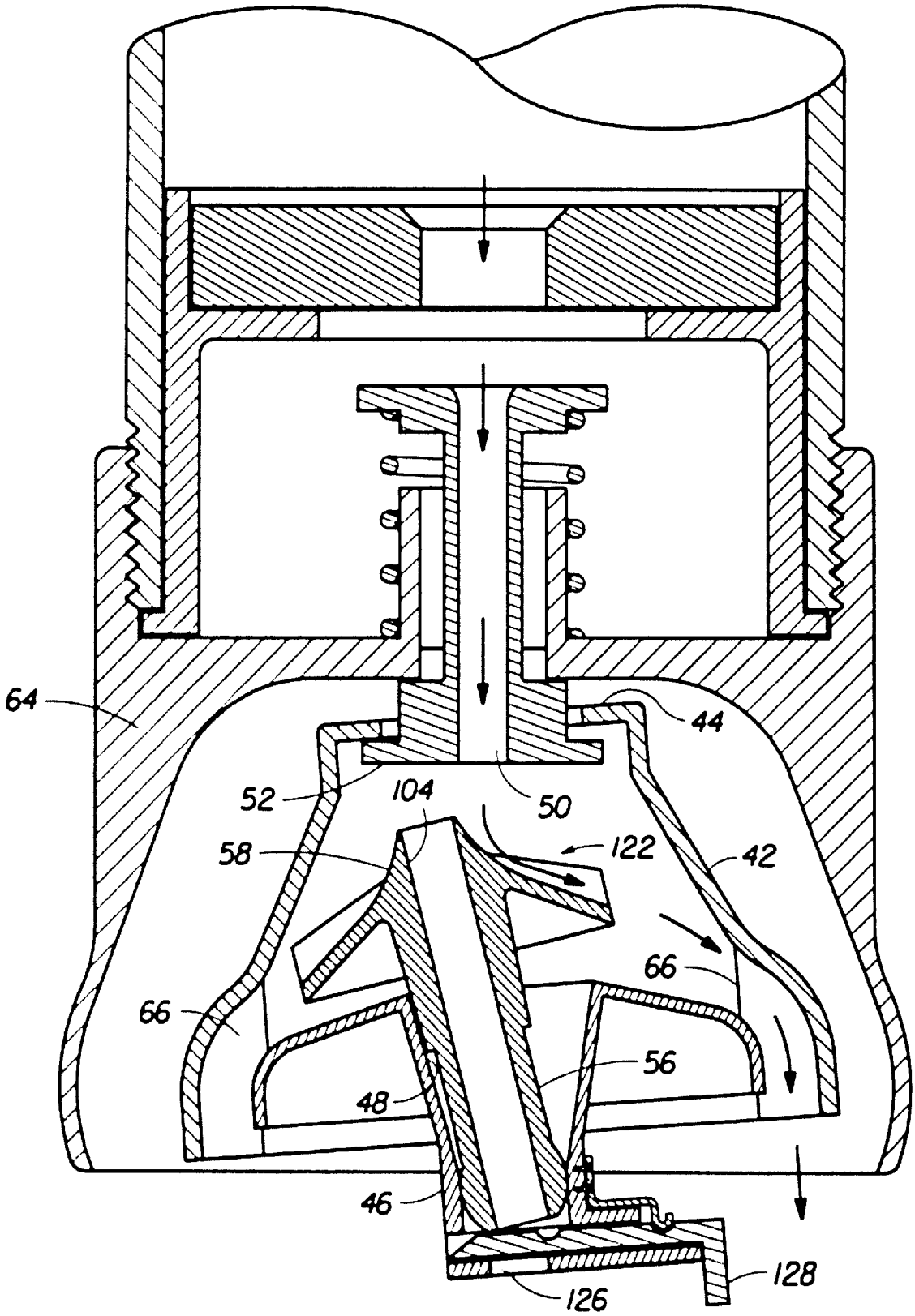

FIGS. 14 and 15 are sectional views of an apparatus 120 similar to that shown in FIG. 2, except that the wobble turbine 122 defines a bore 124 extending through the top of the turbine 58 and through the post 56, preferably along the central axis of the turbine. The lower end of the sleeve 46 defines an opening 126 therein. A valve element 128 is disposed at the lower end of the sleeve 46 and acts to change the flow of the water exiting the shower head assembly 120. The valve element may take any number of forms, including plug valves, needle valves, butterfly valves, gate valves and the like, but is shown here as a manual gate valve or sliding element 128. When the sliding element 128 is in an open condition, the water flows through the bore 124 in the wobble turbine 122 and out the opening 126 in the sleeve 46. This flow pattern provides a compact stream of water that is useful for cleaning a razor, toothbrush or other object. As shown in FIG. 15, when the sliding element is in a closed condition the water is forced to flow over the turbine and out through the outlet channels 66. Alternatively, the inside surface 48 near the lower end of the sleeve 46 may taper inwardly so that when the sliding element 128 is in an open condition, the turbine drops slightly to be secured by the housing, such as by the sleeve gripping the post and/or the housing securely engaging the underneath side of the wobble turbine head. It should be noted that any of the embodiments shown herein may be adapted to use a similar wobble turbine having a bore therethrough and a valve element to provide a narrow stream of water out of the apparatus.

Figure 16:
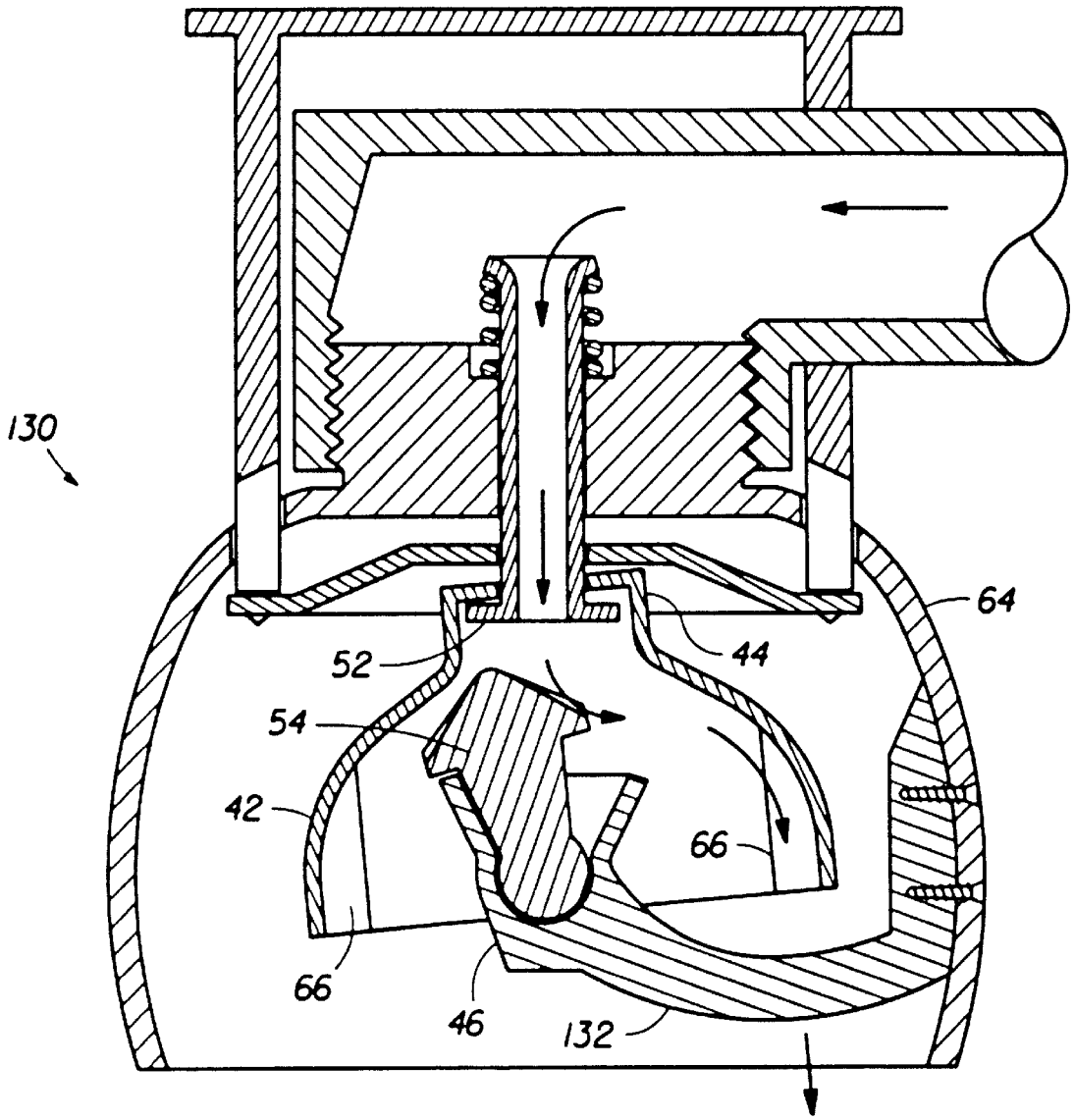
FIGS. 16, 17 and 18 are cross-sectional side views of further embodiments of the apparatus.

FIG. 16 is a cross-sectional side view of a shower head assembly 130 that is similar to the one shown in FIG. 2, except that the outer housing 64 has an arm 132 that rigidly supports the sleeve 46 so that the wobble turbine 54 and the housing 42 wobble independently without contacting each other. In the absence of contact, forces acting upon the turbine 54 are not directly transferred to the housing 42, but rather the water passes over the turbine 54 and is redirected somewhat radially against the inside surface of the housing so that the housing is tilted. As the turbine wobbles, the water stream coming off the turbine 54 causes the housing 42 to wobble.

Figure 17:
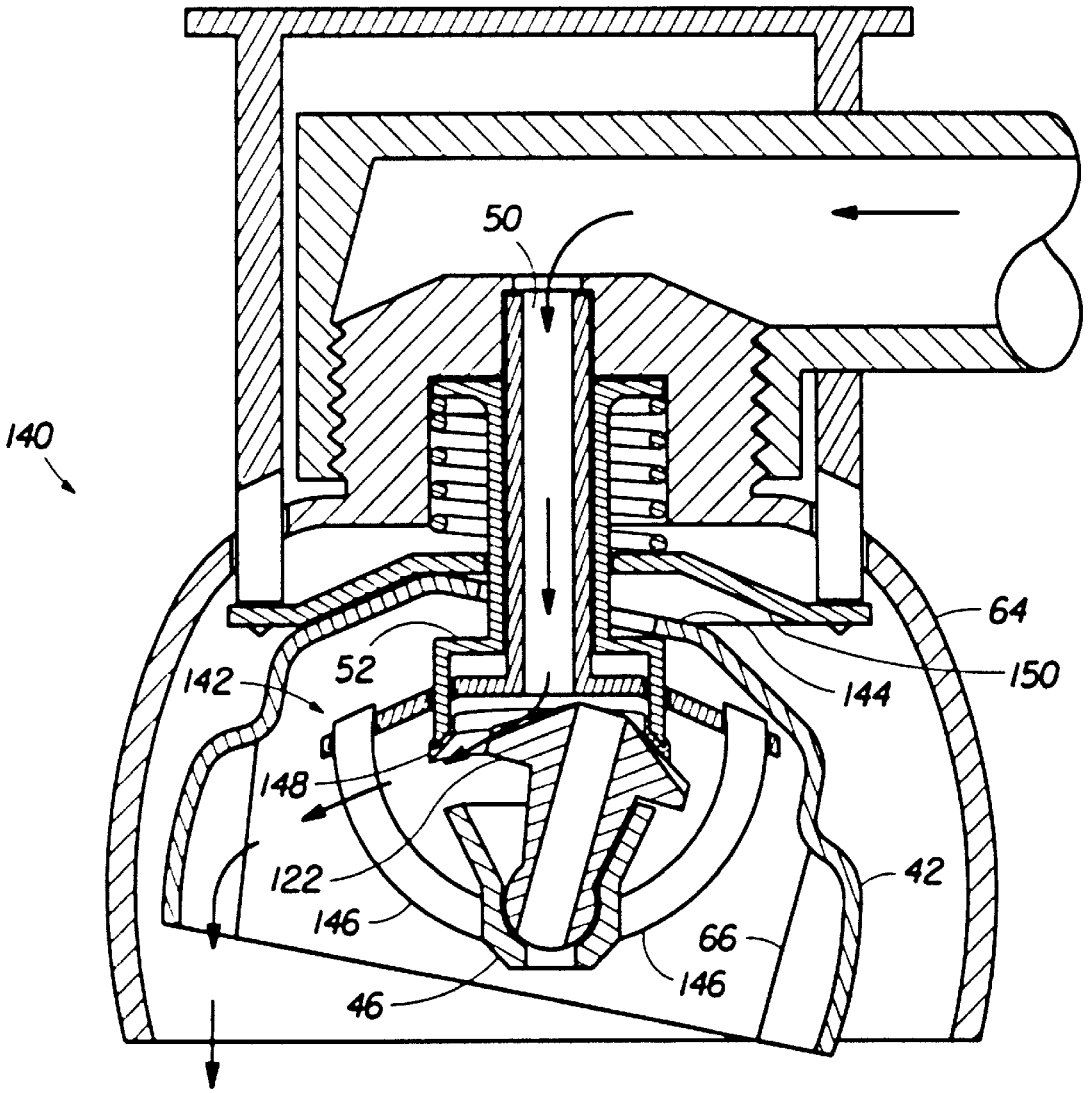

FIG. 17 is a cross-sectional side view of an apparatus 140 that is similar to the one shown in FIG. 16, except that the sleeve 46 is supported from the fluid inlet 50 by a cage or cradle element 142. The wobble turbine 122 is similar to the one shown in FIG. 14, with a bore 124 extending therethrough. The cage 142 supports the sleeve 46 such that the cage and sleeve do not move when the wobble turbine 122 and the housing 42 are moving. The cage 142 consists of arms 146 that are attached to the fluid inlet 50 and the sleeve 46. The arms 146 have a thin cross-section so they do not interfere with the water flow exiting the assembly 140. A wobble limiting ring 148 for limiting the wobble of the turbine 122 extends from the water inlet 50 to a point just above the wobble turbine 122, so that the conical top surface of the wobble turbine can contact the inside surface of the ring 148. The degree of wobble for the housing 42 is similarly limited by the annular wobble plate 44 and collar or space limiting means 52, including a wobble limiting plate 150 which contacts the top of the housing 42 to limit the degree of wobble, thus allowing a compact water stream as in FIG. 14. The wobble limiting plate 150 may be adjusted longitudinally to allow varying degrees of wobble for the housing 42.

Figure 18:
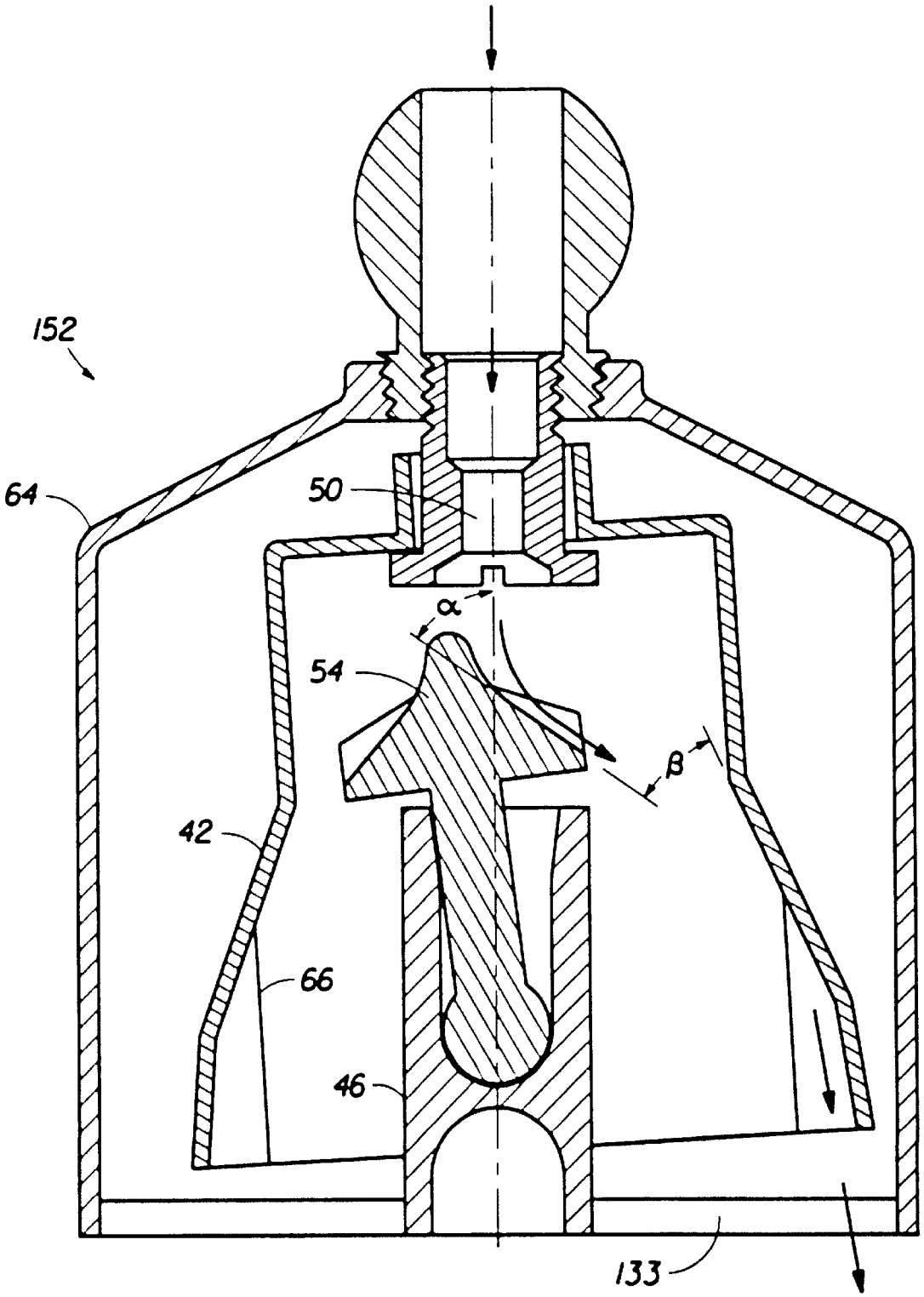

FIG. 18 is a cross-sectional side view of an apparatus 152 that is similar to the one shown in FIG. 16. This design is particularly useful in applications with low water pressure, such as a shower in certain residential or rural areas. The angle of the face of the wobble turbine 54 and the narrow configuration of the housing 42 provides only small changes in the angles of the path that the water has to travel between the entrance to the housing 42 through inlet 50 and the exit from the housing 42. This design allows for the water stream to experience a minimal loss of momentum and, therefore, a minimal drop in water velocity.

Like the assembly in FIG. 16, the outer housing 64 rigidly supports the sleeve 46, although it does so with fins 133 so that the wobble turbine 54 and the housing 42 wobble without contacting each other. In the absence of contact, forces acting upon the turbine 54 are not directly transferred to the housing 42, but rather the water impinges against the face of turbine 54 at an angle ($\alpha$) and is redirected against the inside surface of the housing 42 at a small angle of incidence ($\beta$) so that the housing is tilted, but the water is redirected only slightly and, therefore, the water loses as little velocity as possible.

It should be recognized that the angle $\alpha$ is a function of both the angle at which the turbine shaft is allowed to tilt from its common axis with the water inlet 50 and the angle of the turbine face relative to the turbine shaft. Similarly, the angle $\beta$ is a function of the angle of the water stream redirected from the turbine face, the angle of the sidewall of housing 42, and the angle at which the housing 42 is allowed to tilt relative to the central axis of the water inlet 50.

While the foregoing is directed to the preferred embodiment of the present invention, other and further embodiments of the invention may be devised without departing from the basic scope thereof, and the scope thereof is determined by the claims which follow.

What is claimed is:

1. A fluid discharging apparatus comprising:

a body having a fluid inlet;

a wobble turbine engaged with the body downstream of the fluid inlet and in an axially spaced relationship to the fluid inlet, the wobble turbine having a plurality of stream distributing members configured to cause the wobble turbine to rotate when struck by a stream emitted from the fluid inlet, a fluid outlet; and a deflector, positioned within the body, and disposed to downwardly redirect the distributed stream toward the fluid outlet.

2. The apparatus of claim 1, wherein the deflector is stationary.

3. The apparatus of claim 2, wherein the deflector is rigidly secured to the body.

4. The apparatus of claim 1, wherein the deflector is allowed limited movement.

5. The apparatus of claim 4, wherein the deflector is secured to the wobble turbine.

6. The apparatus of claim 5, further comprising a tracking ring extending from the deflector.

7. The apparatus of claim 5, wherein the deflector wobbles independently of the wobble turbine.

8. The apparatus of claim 7, wherein the deflector has an annular wobble plate freely engaging the body portion.

9. The apparatus of claim 7, wherein the deflector is engaged with the body in a post and sleeve relationship located downstream of the fluid inlet.

10. The apparatus of claim 1, wherein the wobble turbine has a conical surface with angular momentum inducing members formed therein.

11. The apparatus of claim 10, wherein the angular momentum inducing members are selected from grooves, vanes, blades and combinations thereof.

12. The apparatus of claim 1, wherein the wobble turbine engages the body in a post and sleeve relationship.

13. The apparatus of claim 12, wherein the post and sleeve relationship includes a post extending from the wobble turbine and a sleeve supported by the body.

14. The apparatus of claim 12, wherein the post and sleeve relationship includes a sleeve extending from the wobble turbine and a post supported by the body.

15. The apparatus of claim 1, wherein the body has a plurality of outlet channels positioned downstream of the wobble turbine.

16. The apparatus of claim 12, wherein at least a portion of the post and a portion of the sleeve are frusto-conical.

17. The apparatus of claim 1, further comprising a flow control element positioned upstream of the fluid inlet.

18. The apparatus of claim 12, wherein the post has a rounded distal end.

19. The apparatus of claim 11, wherein the angular momentum inducing members are partially tangential relative to the axial centerline of the wobble turbine.

20. The apparatus of claim 13, wherein the sleeve is attached to the body by a plurality of radially extending fins.

21. The apparatus of claim 13, wherein the wobble turbine defines a bore extending longitudinally therethrough, the sleeve defines a bore axially aligned with the wobble turbine bore, and the sleeve comprises an element for selectively opening and closing the bore in the sleeve.

22. The apparatus of claim 13, wherein the wobble turbine defines a bore extending longitudinally therethrough, the sleeve defines a bore axially aligned with the wobble turbine bore, and further comprising a wobble limiting ring in an adjustable spaced relationship with the top of the wobble turbine.

23. The apparatus of claim 1, wherein the wobble turbine is disposed in an axially spaced relationship to the fluid inlet.

24. A fluid discharging apparatus comprising:

a tubular fluid inlet defining space limiting means;

a spray housing having a annular wobble plate freely mounted on the fluid inlet between the space limiting means, a wobble turbine engaged with the spray housing downstream of the fluid inlet and in an axially spaced relationship to the fluid inlet, and a deflector positioned within the spray housing and disposed to downwardly redirect the distributed stream, the wobble turbine having a plurality of stream distributing members formed on one side thereof configured to cause the wobble turbine to rotate when struck by a stream emitted from the fluid inlet.

25. The apparatus of claim 24, wherein the wobble turbine is engaged in a post and sleeve relationship with the housing.

26. A fluid discharging apparatus comprising:

a body having a fluid inlet;

a wobble turbine engaged with the body downstream of the fluid inlet and in an axially-spaced relationship to the fluid inlet, the wobble turbine having a plurality of stream distributing members configured to cause the wobble turbine to rotate when struck by a stream emitted from the fluid inlet, said body having a plurality of outlet channels positioned downstream of the wobble turbine; and a deflector disposed to downwardly redirect the distributed stream.

* * * * *